US008973385B2

(12) United States Patent
Swofford

(10) Patent No.: US 8,973,385 B2
(45) Date of Patent: Mar. 10, 2015

(54) REFRIGERATION SYSTEM

(75) Inventor: Timothy Dean Swofford, Midlothian, VA (US)

(73) Assignee: Hill Phoenix, Inc., Conyers, GA (US)

( * ) Notice: Subject to any disclaimer, the term of this patent is extended or adjusted under 35 U.S.C. 154(b) by 1350 days.

(21) Appl. No.: 12/040,154

(22) Filed: Feb. 29, 2008

(65) Prior Publication Data

US 2008/0209921 A1 Sep. 4, 2008

Related U.S. Application Data

(60) Provisional application No. 60/892,715, filed on Mar. 2, 2007.

(51) Int. Cl.

| | |
|---|---|
| ***F25B 41/04*** | (2006.01) |
| ***A47F 3/04*** | (2006.01) |
| ***F25D 29/00*** | (2006.01) |

(52) U.S. Cl.

CPC ..... *F25D 29/00* (2013.01); *A47F 3/0456* (2013.01); *F25B 2600/21* (2013.01); *F25B 2600/2513* (2013.01); *F25B 2700/1933* (2013.01); *F25B 2700/21174* (2013.01); *F25B 2700/21175* (2013.01); *F25D 2400/16* (2013.01)

USPC ..... 62/222; 62/246

(58) Field of Classification Search

USPC ..... 62/222–225, 246–256

See application file for complete search history.

(56) References Cited

U.S. PATENT DOCUMENTS

| | | | | |
|---|---|---|---|---|
| 4,112,703 | A * | 9/1978 | Kountz | 62/211 |
| 4,333,317 | A * | 6/1982 | Sawyer | 62/212 |
| 4,750,335 | A | 6/1988 | Wallace et al. | |
| 4,765,150 | A | 8/1988 | Persem | |
| RE33,620 | E | 6/1991 | Persem | |
| 5,048,303 | A | 9/1991 | Campbell et al. | |
| 5,109,676 | A * | 5/1992 | Waters et al. | 62/117 |
| 5,228,581 | A | 7/1993 | Palladino et al. | |
| 5,431,547 | A | 7/1995 | Boyko | |
| 5,475,987 | A | 12/1995 | McGovern | |
| 5,513,420 | A | 5/1996 | Kennedy | |

(Continued)

FOREIGN PATENT DOCUMENTS

| | | |
|---|---|---|
| WO | WO 2006/039043 A1 | 4/2006 |
| WO | WO 2006/039664 A2 | 4/2006 |

(Continued)

OTHER PUBLICATIONS

U.S. Appl. No. 61/185,890, filed Jun. 10, 2009, Swofford et al.

(Continued)

*Primary Examiner* — Alexandra Elve
*Assistant Examiner* — Daniel C Comings
(74) *Attorney, Agent, or Firm* — Foley & Lardner LLP

(57) ABSTRACT

A temperature controlled case is provided that includes an enclosure defining an airspace for receiving products therein, a refrigeration system configured to circulate a refrigerant through an expansion device and at least one cooling element to cool the airspace and a control module having a first predetermined setpoint corresponding to a first cooling mode and a second predetermined setpoint corresponding to a second cooling mode. The control module is configured to determine which one of the first cooling mode and the second cooling mode the refrigeration system is to operate within and to apply the corresponding predetermined setpoint for reference in modulating a position of the expansion device.

19 Claims, 3 Drawing Sheets

(56) References Cited

U.S. PATENT DOCUMENTS

| | | | |
|---|---|---|---|
| 5,584,143 | A | 12/1996 | Kennedy |
| 5,586,444 | A | 12/1996 | Fung |
| 6,185,951 | B1 | 2/2001 | Lane et al. |
| 6,298,673 | B1 | 10/2001 | Fung et al. |
| 6,311,512 | B1 | 11/2001 | Fung et al. |
| 6,381,976 | B1 | 5/2002 | Kempiak et al. |
| 6,460,372 | B1 | 10/2002 | Fung et al. |
| 6,519,962 | B1 | 2/2003 | Schuetter |
| 6,619,052 | B1 | 9/2003 | Nash, Jr. |
| 6,679,080 | B2 | 1/2004 | Chiang et al. |
| 6,701,735 | B1 | 3/2004 | Daddis, Jr. et al. |
| 6,708,511 | B2 | 3/2004 | Martin |
| 6,715,311 | B1 | 4/2004 | Wasnock et al. |
| 6,722,149 | B1 | 4/2004 | Saroka et al. |
| 6,745,588 | B2 | 6/2004 | Kahler |
| 6,755,042 | B2 | 6/2004 | Chuang et al. |
| 6,775,994 | B1 | 8/2004 | Math et al. |
| 6,883,343 | B2 | 4/2005 | Lane et al. |
| 6,889,514 | B2 | 5/2005 | Lane et al. |
| 6,889,518 | B2 | 5/2005 | Lane et al. |
| 6,892,546 | B2 | 5/2005 | Singh et al. |
| 6,915,652 | B2 | 7/2005 | Lane et al. |
| 6,955,061 | B2 * | 10/2005 | Chiang et al. ..... 62/255 |
| 6,959,560 | B2 | 11/2005 | Weikel et al. |
| 6,964,173 | B2 | 11/2005 | Dobmeier et al. |
| 6,973,794 | B2 | 12/2005 | Street et al. |
| 6,973,800 | B2 | 12/2005 | Chuang et al. |
| 6,981,384 | B2 | 1/2006 | Dobmeier et al. |
| 6,981,385 | B2 | 1/2006 | Arshansky et al. |
| 6,999,305 | B1 | 2/2006 | Calcote |
| 7,000,422 | B2 | 2/2006 | Street et al. |
| 7,010,924 | B2 | 3/2006 | Kempiak |
| 7,024,870 | B2 | 4/2006 | Singh et al. |
| 7,044,200 | B2 | 5/2006 | Gupte et al. |
| 7,065,979 | B2 | 6/2006 | Arshansky et al. |
| 7,121,104 | B2 | 10/2006 | Howington et al. |
| 7,134,294 | B2 | 11/2006 | Singh et al. |
| 7,159,413 | B2 | 1/2007 | Dail |
| 7,162,882 | B2 | 1/2007 | Alahyari et al. |
| 7,216,500 | B2 | 5/2007 | Schwichtenberg et al. |
| 7,270,278 | B2 | 9/2007 | Street et al. |
| 7,275,376 | B2 | 10/2007 | Swofford et al. |
| 7,299,944 | B2 | 11/2007 | Roady et al. |
| 7,340,907 | B2 | 3/2008 | Vogh, III |
| 7,357,000 | B2 | 4/2008 | Schwichtenberg et al. |
| 7,374,186 | B2 | 5/2008 | Mason et al. |
| 2004/0123613 | A1 | 7/2004 | Chiang et al. |
| 2005/0028539 | A1 | 2/2005 | Singh et al. |
| 2005/0193752 | A1 | 9/2005 | Eisenhower et al. |
| 2005/0252220 | A1 | 11/2005 | Street et al. |
| 2005/0262856 | A1 | 12/2005 | Street et al. |
| 2007/0006604 | A1 | 1/2007 | Behr |
| 2007/0089434 | A1 | 4/2007 | Singh et al. |
| 2007/0089436 | A1 | 4/2007 | Singh et al. |
| 2007/0089437 | A1 | 4/2007 | Singh et al. |
| 2007/0089438 | A1 | 4/2007 | Singh et al. |
| 2007/0089454 | A1 | 4/2007 | Shapiro |
| 2007/0251253 | A1 | 11/2007 | Alahyari et al. |
| 2007/0256390 | A1 | 11/2007 | Teeter |
| 2007/0289323 | A1 | 12/2007 | Swofford et al. |
| 2008/0000241 | A1 | 1/2008 | Larsen et al. |
| 2008/0141690 | A1 | 6/2008 | Behr |
| 2008/0148751 | A1 | 6/2008 | Swofford |
| 2008/0209921 | A1 | 9/2008 | Swofford |
| 2008/0212314 | A1 | 9/2008 | Swofford et al. |
| 2008/0271473 | A1 | 11/2008 | Fung et al. |
| 2008/0282719 | A1 | 11/2008 | Fung |
| 2009/0084125 | A1 | 4/2009 | Fung |
| 2009/0100780 | A1 | 4/2009 | Mathis et al. |
| 2009/0120117 | A1 | 5/2009 | Martin et al. |
| 2009/0133416 | A1 | 5/2009 | Swofford et al. |
| 2009/0205351 | A1 | 8/2009 | Fung |
| 2009/0215381 | A1 | 8/2009 | Swofford |
| 2009/0217686 | A1 | 9/2009 | Bittner |
| 2009/0255287 | A1 | 10/2009 | Alahyari et al. |
| 2009/0260381 | A1 | 10/2009 | Bittner et al. |
| 2009/0293517 | A1 | 12/2009 | Bittner |
| 2009/0293523 | A1 | 12/2009 | Bittner et al. |
| 2009/0320504 | A1 | 12/2009 | Gupte |
| 2010/0023171 | A1 | 1/2010 | Bittner et al. |

FOREIGN PATENT DOCUMENTS

| | | | |
|---|---|---|---|
| WO | WO 2006/115824 | A2 | 11/2006 |
| WO | WO 2007/001284 | A1 | 1/2007 |
| WO | WO 2007/061420 | A1 | 5/2007 |
| WO | WO 2008/051226 | A1 | 5/2008 |
| WO | WO 2008/150297 | A1 | 12/2008 |

OTHER PUBLICATIONS

U.S. Appl. No. 61/174,385, filed Apr. 30, 2009, Wycoff et al.
U.S. Appl. No. 12/702,962, filed Feb. 9, 2010, Wycoff et al.
U.S. Appl. No. 12/699,720, filed Feb. 3, 2010, Bittner et al.
U.S. Appl. No. 12/690,683, filed Jan. 20, 2010, Brown
U.S. Appl. No. 12/612,571, filed Nov. 4, 2009, Leabo et al.
U.S. Appl. No. 12/506,984, filed Jul. 21, 2009, Swofford et al.
U.S. Appl. No. 12/480,510, filed Jun. 8, 2009, Barreto et al.
U.S. Appl. No. 12/355,558, filed Jan. 16, 2009, Martin
U.S. Appl. No. 12/187,957, filed Aug. 7, 2008, Hinde et al.
U.S. Appl. No. 11/913,721, filed May 26, 2005, Decker et al.

* cited by examiner

REFRIGERATION SYSTEM

CROSS-REFERENCE TO RELATED PATENT APPLICATIONS

This application claims the benefit under 35 U.S.C. §119 (e) of U.S. Provisional Application No. 60/892,715, having a filing date of Mar. 2, 2007, and titled "Refrigeration System," the complete disclosure of which is hereby incorporated by reference.

BACKGROUND

The present disclosure relates generally to a refrigeration system for use in a refrigeration device (e.g. temperature controlled case, refrigerated storage unit, merchandiser, cooler, etc.). The present disclosure relates more particularly to a refrigeration system that is suitable for use with refrigeration devices configured to operate between a first cooling mode (e.g., low temperature cooling mode, etc.) and a second cooling mode (e.g., medium temperature cooling mode, etc.). The present disclosure relates more particularly to a control module of the refrigeration system and a method of controlling temperature within the refrigeration device depending for various cooling modes.

It is generally known to provide refrigeration devices (e.g., temperature controlled cases, refrigerated storage units, merchandisers, coolers, etc.) having a refrigeration system for circulating a refrigerant or coolant through one or more cooling elements within the device to maintain items (such as food products and the like) within a certain desirable temperature range. The desirable temperature range will vary depending on the type of items that are received by the refrigeration device. Refrigeration devices are often distinguished by those skilled in the art of commercial refrigeration as being either a "low temperature" refrigeration device or a "medium temperature" refrigeration device. Low temperature refrigeration devices are generally used to display or otherwise support items including, but not limited to, frozen food products or partially frozen food products. Medium temperature refrigeration devices are generally used to display or otherwise support items including, but not limited to, fresh food products.

To maintain items within the refrigeration device at the desirable temperature range, refrigeration systems typically include a control module configured to regulate the positioning of a throttle device to modulate the flow of refrigerant that is supplied to the cooling elements. Based upon signals received from various sensing devices, the control module compares a value representative of an actual reading within the refrigeration device with a predetermined reference value and regulates the positioning of the throttle device accordingly to modulate the flow of refrigerant.

In conventional control modules, only a single predetermined reference value for regulating the position of a throttle device may be inputted by a user and/or manufacturer (e.g., either a predetermined reference value for a low temperature refrigeration device or a predetermined reference value for a medium temperature refrigeration device, etc.). Since the predetermined reference value is different for a low temperature refrigeration device and a medium temperature refrigeration device, a different control module is required for each application.

For certain applications, it may be desirable to change the cooling mode at which the refrigeration device is operating (e.g., convert a low temperature refrigeration device to a medium temperature refrigeration device, convert a medium temperature refrigeration device to a low temperature refrigeration device, etc.). If the refrigeration device is equipped with a conventional control module, the user must add and/or replace a control module in order to complete the conversion process. Adding and/or replacing a control module may increase the expense and/or time required to convert the refrigeration device between a refrigeration device configured to operate at a different cooling mode.

Accordingly, it would be desirable to provide a refrigeration system that can operate between a first cooling mode (e.g., a low temperature cooling mode, etc.) and a second cooling mode (e.g., a medium temperature cooling mode, etc.) without requiring a separate control module for each cooling mode. It would also be desirable to provide a refrigeration system having a control module that is configured to determine whether the refrigeration system is operating within a first cooling mode and a second cooling mode. It would be further desirable to provide a refrigeration system having a control module that is configured to determine whether the refrigeration system is operating within a first cooling mode and a second cooling mode without requiring any manipulation by a user. It would be further desirable to provide a refrigeration system having a control module that modulates the flow of refrigerant through a cooling element. It would be further desirable to provide a refrigeration system that regulates a throttle device (such as a superheat valve) to modulate the flow of refrigerant during the cooling mode. It would also be desirable to provide a refrigeration system having a control module capable of applying a first predetermined setpoint for regulating the throttle device in the first cooling mode and applying a second predetermined setpoint for regulating the throttle device in the second cooling mode.

Accordingly, it would be desirable to provide a refrigeration system for a temperature controlled case having any one or more of these or other desirable features.

SUMMARY

According to one embodiment a temperature controlled case includes an enclosure defining an airspace for receiving products therein, a refrigeration system configured to circulate a refrigerant through an expansion device and at least one cooling element to cool the airspace and a control module having a first predetermined setpoint corresponding to a first cooling mode and a second predetermined setpoint corresponding to a second cooling mode. The control module is configured to determine which one of the first cooling mode and the second cooling mode the refrigeration system is to operate within and to apply the corresponding predetermined setpoint for reference in modulating a position of the expansion device.

According to another embodiment a refrigeration system for a temperature controlled storage unit includes a supply line and a return line coupled to a cooling element and configured to circulate a refrigerant through the cooling element to provide cooling to a space for receiving products. The refrigeration system also includes a control module configured to maintain at least a first cooling mode and a second cooling mode. The control module has a predetermined setpoint temperature. The control module is configured to obtain a saturation temperature of the refrigerant and compare the saturation temperature to the predetermined setpoint temperature to determine which one of the first cooling mode and the second cooling mode the refrigeration system is to operate within.

According to another embodiment, a method of controlling a temperature controlled case includes providing an enclosure having a space configured to receive products to be cooled and providing a cooling element configured to receive a refrigerant to cool the space. The method also includes providing a control module with a predetermined temperature setpoint used for determining whether the case is to operate within a first cooling mode or a second cooling mode, a first predetermined superheat setpoint corresponding to the first cooling mode, a second predetermined superheat setpoint corresponding to the second cooling mode, and signals representative of at least one of a refrigerant pressure and a refrigerant temperature.

DETAILED DESCRIPTION

Figure 1:
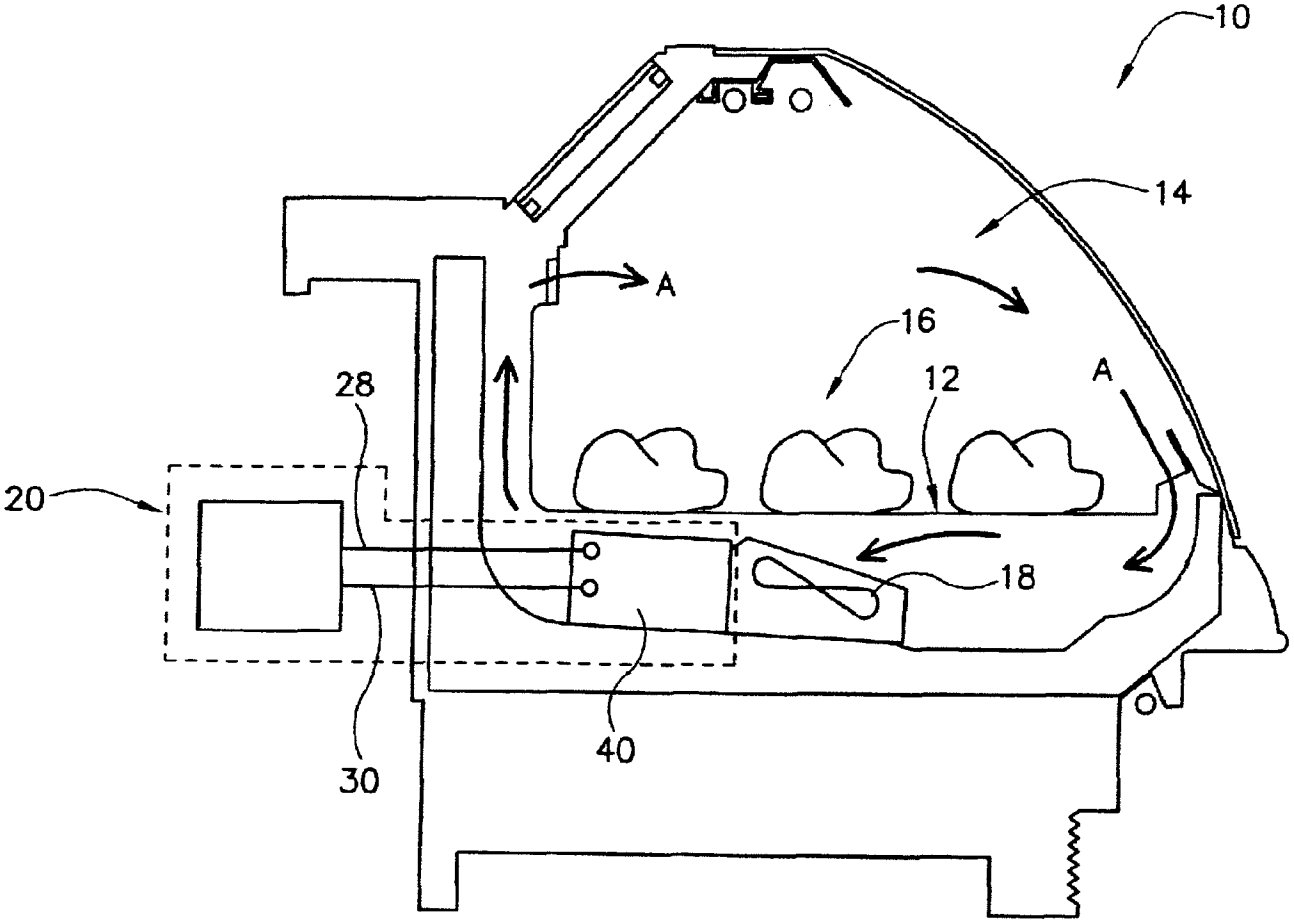
FIG. 1 is a schematic image of a side elevation view of a temperature controlled case according to an exemplary embodiment.

Referring generally to the FIGURES, a refrigeration system for use in a refrigeration device such as a temperature controlled case is shown according to one embodiment. The refrigeration system is shown to have a compressor, condenser, expansion device, one or more cooling elements (e.g., coils, finned-coils, heat exchangers, flow-through pans, etc.), and suitable sensors for circulating a fluid (such as a refrigerant or coolant) through the cooling element to maintain the temperature of products, such as food products within a storage area of the case, at a relatively constant storage temperature. The refrigeration system is further shown as having a control module that interfaces with suitable components of the temperature controlled case and the refrigeration system to enable the temperature controlled case to achieve a desired temperature range and maintain the storage area of the case within such temperature range.

The control module is capable of determining (e.g., recognizing, calculating, etc.) whether the case was intended for operating within a first cooling mode (e.g., a "low temperature cooling mode," etc.) or a second cooling mode (e.g., a "medium temperature cooling mode," etc.). For purposes of this disclosure, the phrase "low temperature cooling mode" is used broadly to refer to applications wherein the storage area of the case is used for displaying frozen or partially frozen products. For example, a low temperature cooling mode may be used to maintain the storage area of the case between approximately negative (–) 15 degrees Fahrenheit (F) and appropriately 15 degrees F., and may include cases operating at a variety of "low" temperatures (e.g., less than approximately 28 degrees F., etc.) for various product storage requirements. A low temperature cooling mode may be used for storing and/or displaying ice cream and/or frozen food products such as frozen vegetables, and/or frozen prepared foods. For purposes of this disclosure, "medium temperature cooling mode" is used broadly to refer to applications wherein the storage area of the case is warmer than the low temperature cooling mode. For example, a medium temperature cooling mode may be used to maintain the storage area of the case between approximately 20 degrees F. and approximately 50 degrees F. A medium temperature cooling mode may be used for storing and/or displaying fresh food products such as milk and other dairy products, fish, meats, and/or produce.

The control module determines whether the case is intended for operating within a first cooling mode or a second cooling mode by comparing an actual reading within the case (e.g., the actual temperature of the refrigerant at the exit (or suction side) of the cooling elements, etc.) (T act) to a predetermined reference range or setpoint (e.g., a temperature range or setpoint, etc.) programmed or otherwise stored within the control module (T ref). If T act is less than T ref, the control module "knows" or is configured to determine that the case is intended to operate within the first cooling mode (e.g., a low temperature cooling mode, etc.). According to an exemplary embodiment, if T act is greater than T ref, the control module "knows" or is configured to determine that the case is intended for operating within the second cooling mode (e.g., a medium temperature cooling mode, etc.).

Programmed or otherwise stored within the control module is a separate predetermined range or setpoint (used for modulating the flow of refrigerant) for both the first cooling mode and the second cooling mode. Once the control module determines whether the case is intended to operate within a first cooling mode or a second cooling mode, the control module applies the predetermined range or setpoint (e.g., a predetermined superheat temperature range or setpoint, etc.) corresponding to the particular cooling mode for modulating the flow of refrigerant. During operation, the control module references this predetermined setpoint in an attempt to maintain the storage area of the case within the desired temperature range. The control module compares this predetermined setpoint to an actual reading within the case (e.g., the actual superheat temperature of the refrigerant, etc.) and maintains the desired temperature range for the case by using the expansion device (e.g., a throttling device such as a superheat valve) to increase or limit the amount of refrigerant being supplied to the cooling element. According to an exemplary embodiment, if the actual reading is greater than the predetermined setpoint, the control module may regulate the expansion device in a way that supplies more refrigerant to the cooling element.

Further, if the control module determines that the case has changed from a case intended to operate within the first cooling mode to a case intended to operate within the second cooling mode (or vice versa), the control module changes the predetermined setpoint for modulating the flow of refrigerant accordingly. The control module is able to change this predetermined setpoint without requiring additional manipulation by a user since a suitable predetermined setpoint is programmed or otherwise stored within the control module for each possible cooling mode. By providing a control module that is capable determining the intended cooling mode of the case, and changing the predetermined setpoint for modulating the flow of refrigerant accordingly without additional manipulation by a user, the refrigeration system is intended to simplify the conversion process and eliminate the need to add and/or replace the control module in the event that a case is intended to change between cooling modes.

Referring to FIG. 1, a refrigeration system for a refrigeration device shown schematically as a temperature controlled case 10 is shown according to an exemplary embodiment. The case 10 is shown as a rear-access, service-type case, but may be any suitable enclosure for maintaining a temperature controlled environment for the storage of objects such as food products and the like (such as open front or open top cases, closed door cases, etc.). The case is shown to include a product support surface 12 within an airspace 14 for storage of products 16, and cooling element(s) 40 configured to cool air circulated with the airspace 14 by a fan 18. According to various alternative embodiments, the cooling element(s) may be positioned at any suitable location within the airspace and the air may be circulated by any type of forced or natural circulation.

The case 10 is capable of operating between a first cooling mode (e.g., a first cooling load application, etc.) and a second cooling mode (e.g., a second cooling load application, etc.). According to an exemplary embodiment, the first cooling mode is a low temperature cooling mode, while the second cooling mode is a medium temperature cooling mode. According to various alternative embodiments, the case may be configured to operate at only one of a first cooling mode and a second cooling mode. According to further alternative embodiments, the case may be configured to operate at or between cooling modes having temperatures outside of one or more of the temperature ranges provided above for the low temperature cooling mode and a the medium temperature cooling mode.

The case 10 may also include a defrost system intended to minimize or generally eliminate the accumulation of frost and/or ice on the surfaces of the cooling element(s) 40. According to an exemplary embodiment, the case 10 may include a defrost system such as that disclosed in U.S. Pat. No. 7,275,376, titled "Defrost System for a Refrigeration Device" filed Apr. 28, 2005, the disclosure of which is hereby incorporated by reference in its entirety.

Figure 2B:
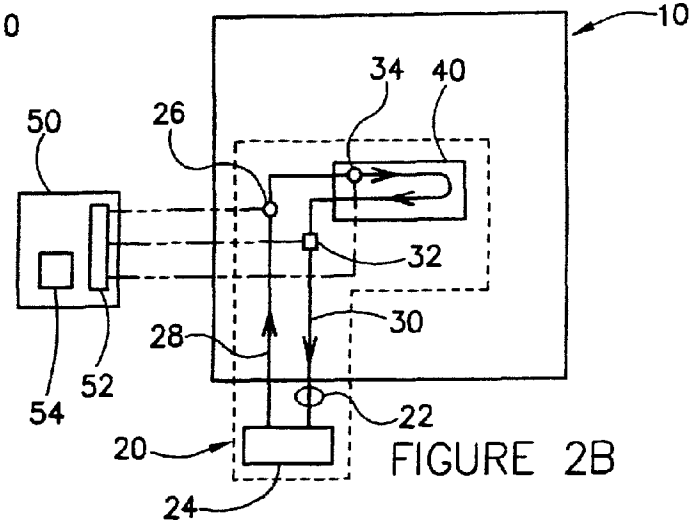
FIGS. 2A-2D are schematic images of a block diagram of a refrigeration system for a temperature controlled case according to exemplary embodiments.
Figure 2A:
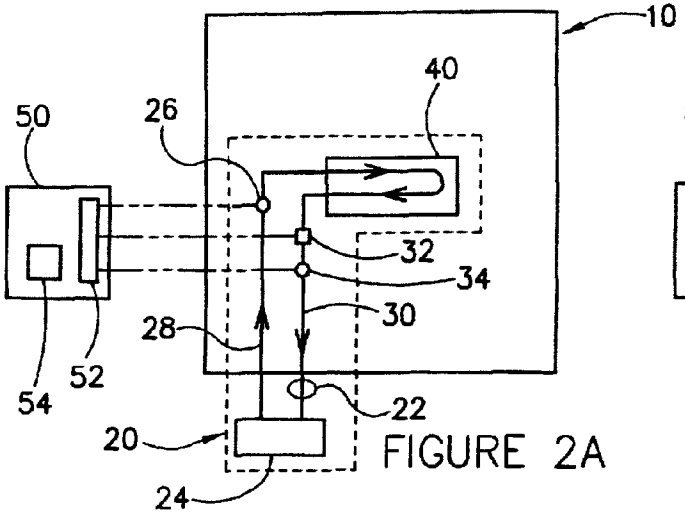
Figure 2D:
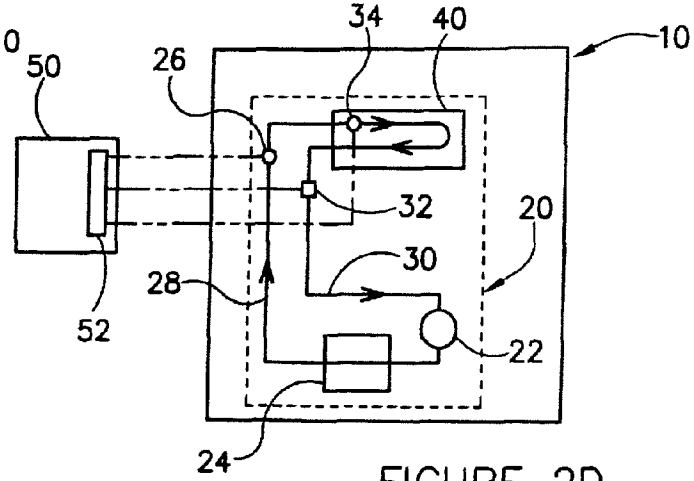

Referring to FIGS. 1-2D, a refrigerant system 20 circulates a refrigerant through a closed loop system shown to include a compressor 22 for compressing a refrigerant vapor, a condenser 24 for cooling and condensing the compressed refrigerant vapor, an expansion metering device (e.g. throttle valve, electronic expansion valve, etc. shown as a superheat valve 26) for "expanding" the liquid refrigerant to a low-temperature saturated liquid-vapor mixture for use in cooling element (s) 40 for cooling airspace 14 and products 16 within the case 10. According to an exemplary embodiment, the refrigerant is any commercially available refrigerant, but may be any suitable refrigerant for use with a refrigeration device. The refrigeration system 20 may be self-contained within the case (as shown schematically in FIGS. 2C and 2D) or a portion of the refrigeration system may be located remotely from the case (as shown schematically in FIGS. 1 and 2A-2B).

According to one embodiment, the refrigerant flows through a refrigerant supply line 28 (e.g. "liquid line" etc.) to the superheat valve 26 at a first flow rate and is expanded by the superheat valve 26 to form a liquid-vapor mixture at a "saturation temperature" within the cooling element(s) 40 to maintain the temperature of the food products 16 at a desired storage or display temperature, consistent with store or industry food safety codes or guidelines.

As the saturated liquid-vapor mixture of refrigerant progresses through the cooling element(s) 40 and absorbs heat from the air circulated from the airspace 14, the vapor percentage of the liquid-vapor mixture increases, and usually becomes completely vaporized. When the refrigerant is completely vaporized within a portion of the cooling element(s) 40 (e.g. usually at or near an outlet portion of the cooling element, such as the last one or several tube passes of a coil), the refrigerant temperature increases above the refrigerant's saturation temperature as the refrigerant continues to circulate through the cooling element(s) 40. The amount of temperature increase above the saturation temperature is referred to herein as the "superheat temperature."

Referring further to FIGS. 2A-2D, the refrigeration system is further shown as comprising a control module 50. The function of control module 50 is at least two-fold. First, the control module 50 is configured to determine whether the case 10 is intended for operating within the low temperature cooling mode or the medium temperature cooling mode. Second, with the intended cooling mode determined (and a corresponding predetermined superheat temperature setpoint established), the control module 50 is configured to modulate the position of the superheat valve 26 to maintain the superheat temperature of the refrigerant within a desired temperature range.

Control module 50 includes a suitable computing device (such as a microprocessor or programmable logic controller 52) configured to receive signals representative of temperature and/or pressure from the components of the case 10 and to provide output signals for controlling the position of the superheat valve 26 to achieve the desired superheat temperature of the refrigerant for the particular cooling mode and to maintain the superheat temperature of the refrigerant within a desired range for that particular cooling mode.

Figure 2C:
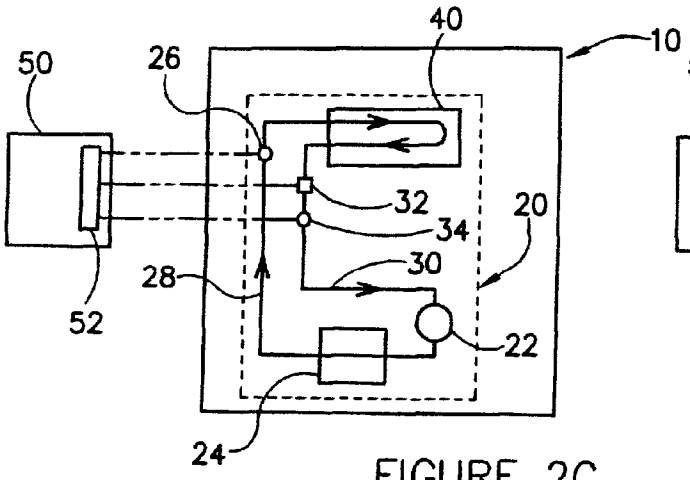

Referring to FIGS. 2A and 2C, a temperature/pressure sensing arrangement is shown to include a temperature sensor 32 and a pressure sensor 34 provided on a refrigerant return line 30 (e.g. "suction" line, etc.) adjacent to the exit of the cooling element(s) 40. The pressure sensor 34 provides a signal representative of refrigerant pressure to the control module 50, which calculates a corresponding saturation temperature (T sat) of the refrigerant at the exit of the cooling element(s) 40, for example, by using a thermodynamic properties look-up table for the particular type of refrigerant being used in the refrigeration system. The temperature sensor 32 provides a signal representative of actual temperature of the refrigerant at the exit of the cooling element(s) 40 (T exit). According to an exemplary embodiment, the temperature sensor 32 is a commercially available thermistor (but could be a thermocouple or RTD of the like) and the pressure sensor 34 is a commercially available pressure transducer. According to various alternative embodiments, the temperature sensor and the pressure sensor may be any other suitable sensor.

The control module 50 determines whether the case 10 is intended for operating within the low temperature cooling mode or the medium temperature cooling mode by comparing T sat to a predetermined setpoint stored within the control module 50 (T ref). T ref may be set at any suitable temperature. According to an exemplary embodiment, if T sat is less than T ref, the control module 50 knows that the case 10 is intended to operate within the low temperature cooling mode. For such an embodiment, if T sat is greater than T ref, the control module 50 knows that the case 10 is intended to operate within the medium temperature cooling mode. According to various alternative embodiments, the value of T ref may vary depending upon the different cooling modes.

Programmed or otherwise stored within the control module 50 is a separate predetermined desired range or setpoint for the superheat temperature for both the low temperature cooling mode and the medium temperature cooling mode. Once the control module 50 determines whether the case 10 is intended for operating within the low temperature cooling mode or the medium temperature cooling mode, the control module 50 applies the predetermined setpoint for the superheat temperature corresponding to the intended cooling mode when controlling the temperature of the case.

The control module 50 uses the predetermined superheat temperature setpoint as a reference when controlling the position of the superheat valve 26. During the low temperature cooling mode and the medium temperature cooling mode, the superheat valve 26 is configured to modulate a flow rate of the refrigerant corresponding to the duty or demand experienced by the case 10. The flow rate may be increased during high demand and the flow rate may be decreased during low demand, so that the temperature of refrigerant in the cooling element(s) 40 maintains the storage area within the desired temperature ranges.

Still referring to FIGS. 2A and 2C, the temperature/pressure sensing arrangement of the control module 50 is configured to provide output signals for controlling the position of the superheat valve 26 to maintain the superheat temperature of the refrigerant within a desired range for both the low temperature cooling mode and the medium temperature cooling mode. The control module 50 calculates the difference between T exit and T sat to determine the actual superheat temperature of the refrigerant. The control module 50 compares the actual superheat temperature of the refrigerant to the relevant predetermined setpoint for the superheat temperature and sends an output signal to modulate the position of the superheat valve 26 to attain or maintain the desired superheat temperature at the exit of the cooling element(s) 40.

The saturation temperature of the refrigerant for the medium temperature cooling mode is typically within a range of approximately 17-32 degrees F., and more particularly within a range of 22-29 degrees F. The saturation temperature of the refrigerant is intended to maintain at least a portion of the cooling element(s) 40 at a temperature corresponding approximately to the refrigerant's saturation temperature during the respective cooling mode.

Referring to FIGS. 2B and 2D, a temperature/temperature sensing arrangement is shown to include a first temperature sensor 36 located at an inlet area of the cooling element(s) (e.g. on a first pass of a coil 42 of a cooling element, etc.) and a second temperature sensor 32 located adjacent to the exit of the cooling element(s) 40. The first temperature sensor 36 is intended to provide a signal that is reasonably representative of the saturation temperature (T sat) of the refrigerant to the control module 50. The second temperature sensor 32 is intended to provide a signal representative of the actual temperature of the refrigerant at the exit of the cooling element(s) 40 (T exit).

Similar to the exemplary embodiment detailed above, the control module 50 determines whether the case 10 is intended for operating within the low temperature cooling or the medium temperature cooling mode by comparing T sat to a predetermined setpoint programmed or otherwise stored within the control module 50 (T ref). However, unlike the exemplary embodiment detailed above, the control module 50 does not have to calculate T sat, but instead receives a signal from the first temperature sensor reasonably representative of T sat.

Once the control module 50 determines whether the case 10 is intended to operate within the low temperature cooling mode or the medium temperature cooling mode, the control module 50 applies the appropriate predetermined setpoint for the superheat temperature to control the temperature of the case 10. The control module 50 calculates the difference between T exit and T sat to determine the actual superheat temperature of the refrigerant. The control module 50 compares the actual superheat temperature of the refrigerant to the selected predetermined desired setpoint for the superheat temperature and sends an output signal to modulate the position of the superheat valve to attain or maintain the desired superheat temperature at the exit of the cooling element. According to alternative embodiments, the temperature and/or pressure sensors may be provided at any suitable location and on any suitable component to provide signals sufficient to control the superheat temperature of the refrigerant as the refrigerant passes through the cooling element.

Figure 3:
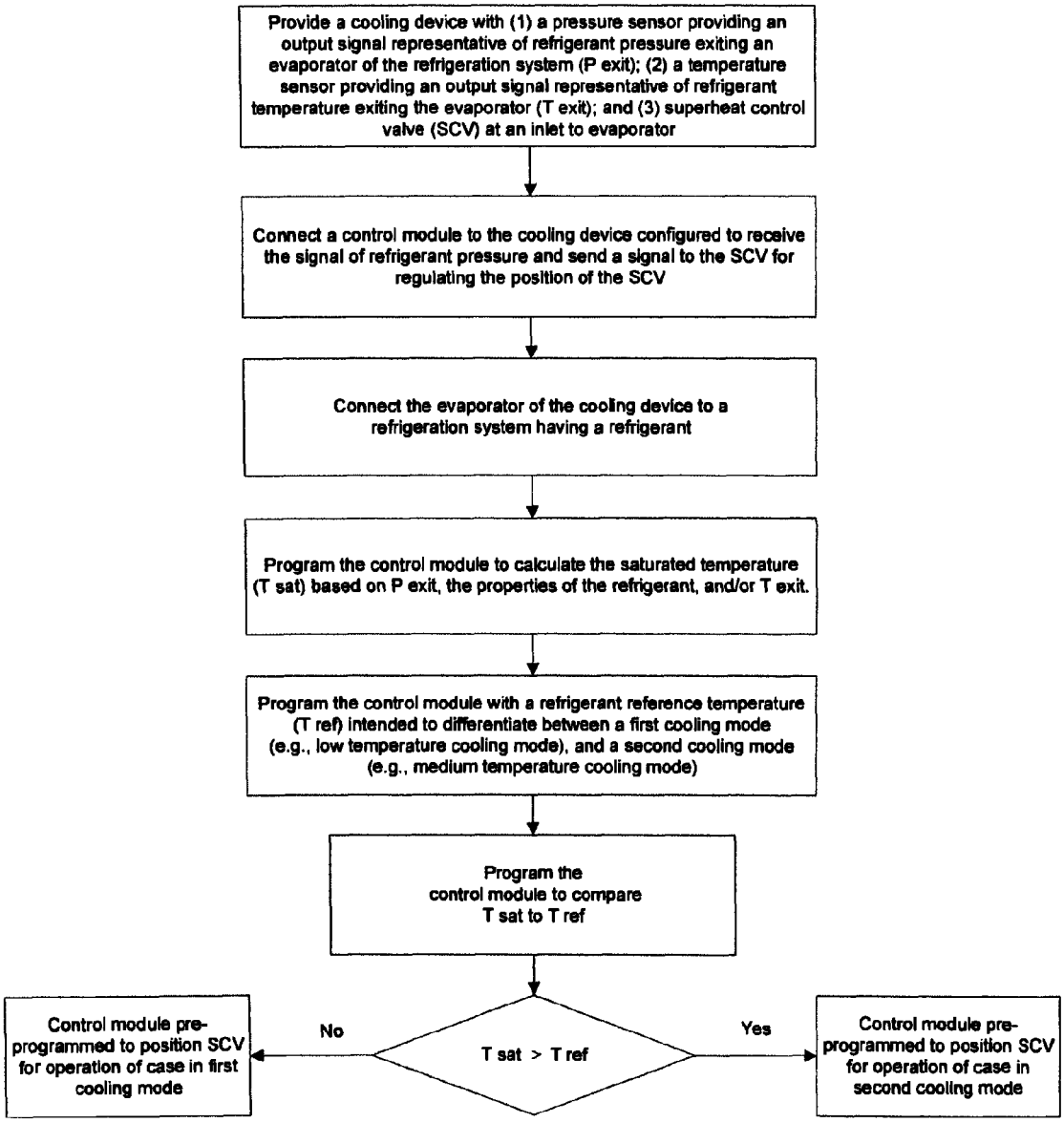
FIG. 3 is a flow chart illustrating a method of controlling the refrigeration system of FIGS. 2A and 2C.

Referring to FIG. 3, a method of controlling a refrigeration system is shown according to an exemplary embodiment. The method includes providing an enclosure having a space configured to receive products to be cooled and providing a refrigeration system with a compressor, a condenser, an expansion device, such as a superheat control valve (SCV), one or more cooling elements, suitable sensors for circulating a refrigerant through the cooling element to maintain the temperature of products at a relatively constant storage temperature, and a control module. According to the embodiment illustrated, the refrigeration system includes a pressure transducer or sensor and a temperature sensor provided at a refrigerant return or suction line. The pressure sensor provides a signal representative of refrigerant pressure to the control module (P exit), while the temperature sensor provides a signal representative of actual temperature of the refrigerant at the exit of the cooling elements (T exit).

The method also includes providing the control module with a predetermined temperature setpoint (T ref) used for determining whether the case is to operate within a first cooling mode (e.g., a low temperature cooling mode, etc.) or a second cooling mode (e.g., a medium temperature cooling mode, etc.), a first predetermined superheat setpoint corresponding to the first cooling mode, a second predetermined superheat setpoint corresponding to the second cooling mode. According to an exemplary embodiment, the control module calculates a saturated suction temperature (T sat) based on P exit, T exit, and/or the properties or parameters of the refrigerant. The method further includes programming the control module to determine which cooling mode the refrigeration system is to operate by comparing T sat to T ref. The method further includes programming the control module to use the first predetermined superheat setpoint if T sat is less than T ref and to use the second predetermined superheat setpoint if T sat is greater than T ref.

The method further includes programming the control module to calculate the actual superheat temperature of the refrigerant and to compare the actual superheat temperature of the refrigerant to either the first predetermined superheat setpoint or the second predetermined superheat setpoint (depending on whether the control module determined that the refrigeration system is to operate within the first cooling mode or the second cooling mode). The method further includes regulating the position of the superheat control valve based on the comparison of the actual superheat temperature to the appropriate predetermined superheat setpoint for modulating the flow of refrigerant to the cooling element.

It is also important to note that the construction and arrangement of the elements of the refrigeration system for a temperature controlled case as shown schematically in the embodiments is illustrative only. Although only a few embodiments have been described in detail in this disclosure, those skilled in the art who review this disclosure will readily appreciate that many modifications are possible (e.g., variations in the ranges of the different cooling modes for a low temperature cooling mode and a medium temperature cooling mode, variations in superheat temperature during the different cooling modes, values of parameters, etc.) without materially departing from the novel teachings and advantages of the subject matter recited.

It should also be noted that suitable sensors may be provided within the case or integrally (or otherwise operably coupled) with the cooling elements(s) to provide input to the refrigeration control system. For example, one or more temperature sensing devices (e.g. thermocouples, RTDs, etc.) may be provided at suitable location(s) within, or on the top side or underside of shelves or other product support surfaces to provide a signal representative of temperature of the product support surface and/or food products to the refrigeration control system. The control module may include a processor such as a microprocessor, programmable logic controller or the like for receiving and monitoring input signals, sending output signals, permitting change or adjustment of setpoints, providing appropriate indications (e.g. alarms, status, temperature, fluid flow rates, mode of operation (such as a first cooling mode or a second cooling mode), etc.) and to interface with local or remote monitoring equipment or stations. The control module may also be configured to initiate a conversion between different cooling modes in any suitable manner. Further, an evaporator pressure regulating (EPR) valve can be added to a low temperature case to convert the case to a medium temperature case. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present inventions as expressed in the appended claims.

What is claimed is:

1. A temperature controlled case, comprising:

an enclosure defining an airspace for receiving products therein;

a refrigeration system configured to circulate a refrigerant through an expansion device and at least one cooling element to cool the airspace in one of a low temperature cooling mode and a medium temperature cooling mode; and a control module configured to determine whether the case is intended to operate as a low temperature case associated with the low temperature cooling mode of the refrigeration system or a medium temperature case associated with the medium temperature mode of the refrigeration system, the control module having a first predetermined setpoint corresponding to the low temperature cooling mode and a second predetermined setpoint corresponding to the medium temperature cooling mode;

wherein when the control module receives a signal representative of the refrigeration system operating in the low temperature cooling mode, the control module applies the corresponding predetermined first setpoint to modulate a position of the expansion valve to continuously operate the case as the low temperature case, and wherein when the control module receives a signal representative of the refrigeration system operating in the medium temperature cooling mode, the control module applies the corresponding predetermined second setpoint to modulate a position of the expansion valve to continuously operate the case as the medium temperature case.

2. The temperature controlled case of claim 1 wherein the airspace temperature is within the range of approximately negative 15 degrees F. to approximately 15 degree F. during the low temperature cooling mode and within the range of approximately 20 degrees F. to approximately 50 degrees F. during the medium cooling mode.

3. The temperature controlled case of claim 1 wherein the control module further includes a predetermined reference temperature for comparison in determining which one of the low temperature cooling mode and the medium temperature cooling mode the refrigeration system is operating within.

4. The temperature controlled case of claim 3 wherein the control module compares a saturation temperature of the refrigerant to the predetermined reference temperature for determining which one of the low temperature cooling mode and the medium temperature cooling mode the refrigeration system is operating within.

5. The temperature controlled case of claim 4 wherein the control module calculates the saturation temperature of the refrigerant based on a signal representative of refrigerant pressure and the parameters of the refrigerant.

6. The temperature controlled case of claim 4 wherein the control module receives a signal from a temperature sensor representative of the saturation temperature of the refrigerant.

7. The temperature controlled case of claim 1 wherein the first predetermined setpoint comprises a first predetermined superheat temperature setpoint and the second predetermined setpoint comprises a second predetermined superheat temperature setpoint.

8. The temperature controlled case of claim 7 wherein the expansion device comprises a superheat valve.

9. The temperature controlled case of claim 8 wherein the control module compares an actual superheat value of the refrigerant with one of the first predetermined superheat temperature setpoint and the second predetermined superheat temperature setpoint and provides an output signal to modulate the position of the superheat valve.

10. The temperature controlled case of claim 9 wherein the control module calculates the difference between a saturation temperature of the refrigerant and an actual temperature of the refrigerant at the cooling element to determine the actual superheat temperature of the refrigerant.

11. The temperature controlled case of claim 10 wherein the control module is configured to receive a signal representative of refrigerant pressure near the cooling element and use the signal representative of refrigerant pressure to calculate the saturation temperature of the refrigerant.

12. The temperature controlled case of claim 10 wherein the control module is configured to receive a signal representative of the saturation temperature of the refrigerant from a temperature sensor near the cooling element.

13. A temperature controlled storage unit for use with both a low temperature cooling mode and a medium temperature cooling mode of a refrigeration system, the unit comprising:

a cooling element configured to be coupled to a supply line and a return line of the refrigeration system to circulate a refrigerant through the cooling element to provide cooling to a space for receiving products; and a control module configured to determine whether the unit is intended to operate as a low temperature case associated with the low temperature cooling mode of the refrigeration system or a medium temperature case associated with the medium temperature mode of the refrigeration system, the control module having a predetermined setpoint temperature, wherein when the control module compares a saturation temperature of the refrigerant to the predetermined setpoint and determines that the unit is to operate as a low temperature unit associated with the low temperature cooling mode, the control module continuously operates the unit as the low temperature unit, and wherein when the control module compares a saturation temperature of the refrigerant to the predetermined setpoint and determines that the unit is to operate as a medium temperature unit associated with the medium temperature cooling mode, the control module continuously operates the unit as the medium temperature unit.

14. The refrigeration system of claim 13 wherein the control module further includes a first predetermined superheat temperature setpoint corresponding to the low temperature cooling mode and a second predetermined superheat temperature setpoint corresponding to the medium temperature cooling mode and wherein the control module is configured to use the first predetermined superheat temperature setpoint when the system is operating within the low temperature cooling mode and use the second predetermined superheat temperature setpoint when the system is operating within the medium temperature cooling mode.

15. A method of controlling a temperature controlled case, comprising:

providing an enclosure having a space configured to receive products to be cooled;

providing a cooling element configured to receive a refrigerant from a refrigeration system to cool the space; and providing a control module with a predetermined temperature setpoint that determines whether the case is to operate within a first cooling mode of the refrigeration system or a second cooling mode of the refrigeration system based upon signals representative of at least one of a refrigerant pressure and a refrigerant temperature of the refrigeration system, the control module further including a first predetermined superheat setpoint corresponding to the first cooling mode, and a second predetermined superheat setpoint corresponding to the second cooling mode;

so that when the control module determines that the case is to operate as a low temperature case associated with the first temperature cooling mode, the control module continuously operates the case as the low temperature case, and when the control module determines that the case is to operate as a medium temperature case associated with the medium temperature cooling mode, the control module continuously operates the case as the medium temperature case.

16. The method of claim 15 wherein the control module uses the first predetermined superheat setpoint to modulate a superheat valve if the case is to operate as a low temperature case within the first cooling mode and uses the second predetermined superheat setpoint to modulate the superheat valve if the case is to operate as a medium temperature case within the second cooling mode, wherein the first cooling mode corresponds to a low temperature cooling mode and the second cooling mode corresponds to a medium temperature cooling mode.

17. The method of claim 16 wherein the control module is configured to regulate the superheat valve during one of the first cooling mode and the second cooling mode based on signals representative of a temperature and a pressure of the refrigerant near an outlet of the cooling element in comparison with the respective first predetermined superheat setpoint and second predetermined superheat setpoint.

18. The method of claim 17 wherein the control module is configured to regulate the superheat valve during one of the first cooling mode and the second cooling mode based on a signal representative of a temperature of the refrigerant proximate an outlet of the cooling element and a signal representative of a temperature of the refrigerant proximate an inlet of the cooling element in comparison with the respective first predetermined superheat setpoint and second predetermined superheat setpoint.

19. The method of claim 15 wherein the first cooling mode is a low temperature cooling mode and the second cooling mode is a medium temperature cooling mode.

* * * * *